United States Patent [19]

Cudby

[11] 4,003,561

[45] Jan. 18, 1977

[54] POURING OF METALS

[75] Inventor: Joseph William Cudby, Sheffield, England

[73] Assignee: United States Steel Corporation, Pittsburgh, Pa.

[22] Filed: Nov. 18, 1974

[21] Appl. No.: 524,916

[30] Foreign Application Priority Data

Nov. 23, 1973 United Kingdom ..... 54418/73

[52] U.S. Cl. ..... 266/220; 266/236; 222/600; 222/603

[51] Int. Cl.[2] ..... F16K 51/00

[58] Field of Search ..... 266/34 PP, 38, 217, 266/218, 220–223, 236; 222/591, 594–600, 603

[56] References Cited

UNITED STATES PATENTS

| | | | |
|---|---|---|---|
| 1,763,248 | 6/1930 | Moore | 266/34 PP |
| 3,253,307 | 5/1966 | Griffiths et al. | 222/130 X |
| 3,459,346 | 8/1969 | Tinnes | 222/566 |
| 3,511,261 | 5/1970 | Bick et al. | 266/38 X |
| 3,615,086 | 10/1971 | Jepson et al. | 266/34 PP |
| 3,731,912 | 5/1973 | Kutzer | 266/34 PP |
| 3,743,139 | 7/1973 | Lyman | 266/34 L |
| 3,744,781 | 7/1973 | Gabler | 266/34 PP |
| 3,773,226 | 11/1973 | Kutzer | 222/148 |
| 3,809,146 | 5/1974 | Andrzajak | 266/34 PP |
| 3,825,241 | 7/1974 | Shapland | 266/38 |
| 3,838,798 | 10/1974 | Voss | 266/34 PP |

FOREIGN PATENTS OR APPLICATIONS

| | | | |
|---|---|---|---|
| 834,234 | 5/1960 | United Kingdom | 222/DIG. 11 |

*Primary Examiner*—Gerald A. Dost
*Attorney, Agent, or Firm*—Walter P. Wood

[57] ABSTRACT

A sliding gate valve assembly adapted for use in the pouring of metals comprises a sliding gate member arranged for sliding movement to open and close an orifice of the assembly through which orifice metal is arranged to flow; the sliding gate member comprises a refractory body in which is provided a nozzle aligned with the orifice in an open position of the gate member and offset from the orifice in a closed position of the gate member; the nozzle has a side wall portion of permeable refractory material; and gas, e.g. an inert gas or oxygen is supplied to the nozzle, through the permeable side wall portion.

3 Claims, 4 Drawing Figures

POURING OF METALS

This invention is concerned with improvements in or relating to the pouring of metals, for example steel.

In for example one process for the continuous pouring of steel, the flow of molten steel from a bottom pour ladle or tundish is controlled by a sliding gate valve assembly, in which a sliding gate member having a nozzle is arranged to slide in contact with a stationary orifice plate. Examples of such sliding gate valve assembles are described in Shapland Reissue U.S. Pat. No. 27,237 and U.S. Pat. No. 3,501,068, Shapland et al application Ser. No. 377,385 filed July 9, 1973, and Cudby application Ser. No. 380,808, filed July 19, 1973 (now U.S. Pat. No. 3,904,566). The foregoing patents and applications are concerned with arrangements in which the sliding gate member is linearly reciprocable. In an alternative arrangement the sliding gate is rotary and one example of this is described in Lyman U.S. Pat. No. 3,430,644. The foregoing patents and applications and the present application are of common ownership.

When for example aluminum killed steel is poured from a ladle or tundish through a sliding gate valve assembly uneven pouring and blockage of the sliding gate nozzle are liable to arise through the action of deoxidation products which are present. Similar problems may also arise with the following steels:

a. Silicon and/or manganese deoxidised steels which are treated with aluminum for grain refinement;

b. Alloy steels containing the following alloying or grain-refining elements, namely titanium, vanadium, tungsten, chromium, and zirconium. Also, steels containing rare earth metal additions such as cerium and lanthanum and the oxides thereof; and c. Un-killed steels such as high carbon rimming grades e.g. those having 0.15% weight carbon. These are generally poured at relatively low temperatures and thus prone to freezing.

Also for example generally in the pouring of steel into a tundish, the metal first reaches a well area above an outlet nozzle of the tundish which may have an extended pouring tube. This metal is liable to cool and solidify in the well area causing a blockage.

It is one object of the present invention to provide an improved sliding gate valve assembly, wherein the above problems are minimised.

The invention provides a sliding gate valve assembly adapted for use in the pouring of metals and comprising a sliding gate member arranged for sliding movement to open and close an orifice of the assembly through which orifice metal is arranged to flow, the sliding gate member comprising (a) a refractory body in which is provided a nozzle which is aligned with the orifice in an open position of the gate member and offset from the orifice in a closed position of the gate member, the nozzle having a side wall portion of permeable refractory material, and (b) an inlet arranged for the supply of gas for passage through the permeable side wall portion into the nozzle.

The side wall portion is for example provided by a sleeve of said permeable refractory material supported in an annular member of refractory material. The sleeve extends for example for at least 50% of the length of the nozzle (e.g. substantially the whole length of the nozzle), and so that gas supplied through the sleeve is available in the region of the orifice of the assembly.

The internal diameter of the nozzle is for example between 25 m.m and 120 m.m., e.g. between 38 m.m and 120 m.m. The gas may be for example an inert gas, e.g. argon or nitrogen, or an active or fuel gas, e.g. oxygen or propane.

When the inert gas is used for example in the pouring of aluminum killed steel it is believed to act by flushing the deoxidation products, thus minimising the risk of uneven flow or blockage of the sliding gate nozzle.

Should blockage actually occur, for example in the pouring of steel into a tundish or in other suitable cases of nozzle blockage, oxygen may be supplied through the permeable side wall portion of the sliding gate nozzle to release the blockage.

It will be realised that a sliding gate valve assembly according to the invention may also be employed in any other suitable case where it is desired to supply a gas to the nozzle of the sliding gate member.

The invention also provides a sliding gate valve assembly adapted for use in the pouring of steel and comprising a sliding gate member arranged for linear sliding movement to open and close an orifice of the assembly through which orifice steel is arranged to flow, the sliding gate member comprising (a) a refractory body in which is provided a nozzle which is aligned with the orifice in an open position of the gate member and offset from the orifice in a closed position of the gate member, the nozzle having a side wall portion of permeable refractory material, and (b) an inlet arranged for the supply of gas for passage through the permeable side wall portion into the nozzle.

The invention also comprehends a sliding gate member adapted for use in a sliding gate valve assembly according to the invention.

The invention also provides a sliding gate member adapted for use in the pouring of steel and for sliding movement to open and close an orifice through which orifice steel is arranged to flow when the sliding gate member is in use, the sliding gate member comprising (a) a refractory body encased in a thin-walled steel casing and in which is provided a nozzle having a side wall portion of permeable refractory material, and (b) an inlet arranged for the supply of gas for passage through the permeable side wall portion into the nozzle.

The invention also comprehends a metal pouring plant comprising a sliding gate valve assembly according to the invention.

The invention also provides a steel pouring plant comprising a bottom pour vessel and a sliding gate valve assembly arranged to control flow of steel from the vessel and comprising (a) a stationary orifice plate with an orifice therein through which the steel is arranged to flow, and (b) a sliding gate member resiliently urged by springs into sealing engagement with the orifice plate and arranged for linear sliding movement to open and close the orifice, the sliding gate member comprising (i) a refractory body in which is provided a nozzle which is aligned with the orifice in an open position of the gate member and offset from the orifice in a closed position of the gate member, the nozzle having a side wall portion of permeable refractory material, and (ii) an inlet arranged for the supply of gas for passage through the permeable side wall portion into the nozzle; a supply of gas being connected to the inlet.

The invention also provides a method of supplying gas to a nozzle of a sliding gate member through which nozzle metal is arranged to flow, wherein the gas is supplied through a permeable side wall portion of the nozzle.

The invention also comprehends metal pouring methods.

The invention also provides a method of pouring aluminium killed steel through a nozzle of a sliding gate member, wherein argon is supplied to the nozzle through a permeable side wall portion of the nozzle without substantially throttling the flow of steel through the nozzle.

There now follows a description, to be read with reference to the accompanying drawings, of a sliding gate valve assembly embodying the invention. This description, which is also illustrative of method aspects of the invention, is given by way of example of the invention only and not by way of limitation thereof.

Figure 1:
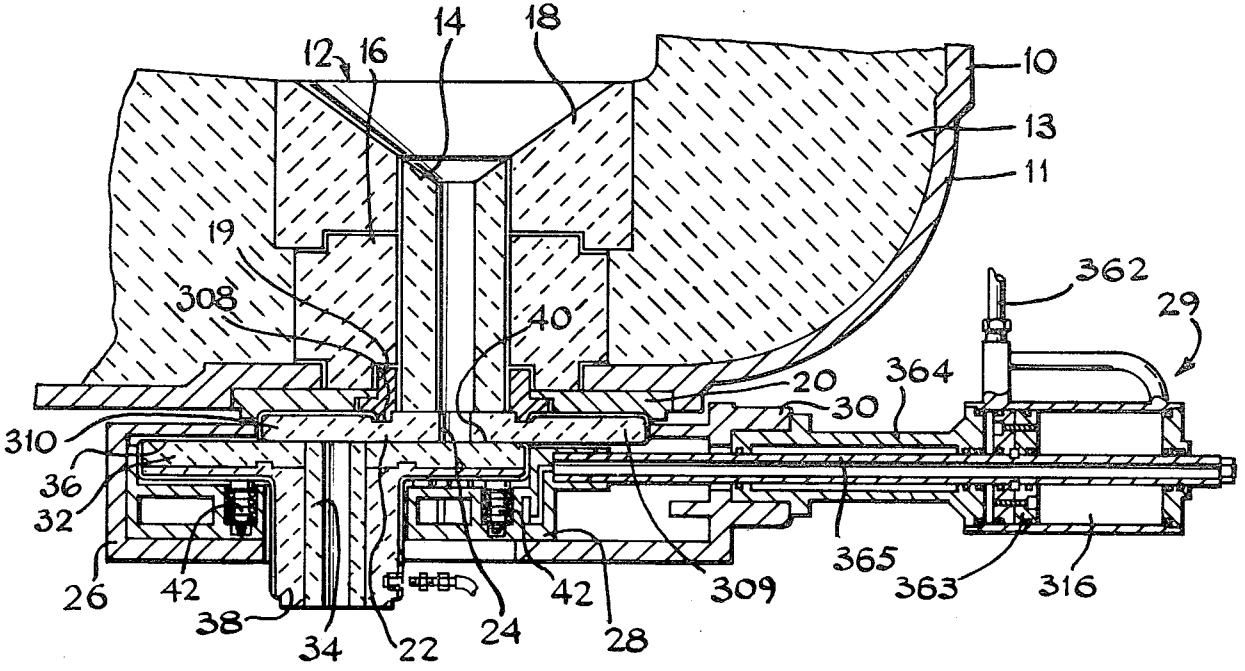
FIG. 1 shows a sectional side view of the sliding gate valve assembly embodying the invention.

The sliding gate valve assembly embodying the invention is adapted for use in the pouring of steel e.g. aluminium killed steel to control flow of the steel into an ingot mould (not shown) or a tundish of a continuous casting plant from a bottom pour ladle 10 which comprises an outer metal casing 11 and a refractory lining 13. A nozzle assembly 12 is mounted in the ladle 10 and comprises a refractory nozzle tube 14 supported within refractory blocks 16, 18 and in refractory outer nozzle member 19 mounted in a metal mounting plate 20 secured to the outer metal casing 11 of the ladle 10. A stationary orifice plate 22 of refractory material is secured generally below the mounting plate 20 and comprises an orifice 24 in alignment with the nozzle tube 14.

The sliding gate valve assembly also comprises a framework 26 removably secured to the mounting plate 20 by a toggle mechanism as described in more detail in said application Ser. No. 377,385; a sliding gate carrier 28 is mounted for linear horizontal sliding movement in the framework 26. The horizontal sliding movement of the carrier 28 is effected by hydraulic cylinder and piston assembly 29 mounted in a bracket 30 of the framework 26. A refractory sliding gate 32 is supported in the carrier 28 and comprises a nozzle sleeve tube 34 extending downwardly from the region of the stationary plate 22. The nozzle tube 34 is supported in upper and lower refractory ring members 36, 38. A lower surface 40 of the stationary plate 22 provides an upstream seating for the sliding gate 32.

It will be realised that the sliding gate 32 is movable between a closed position as shown in FIG. 1 in which tube 34 is offset from the orifice 24, and an open position (not shown) in which the tube 34 is aligned with the orifice 24 and molten steel is free to flow from the ladle 20 into the ingot mould or tundish through the tube 14, the orifice 24 and the tube 34.

The sliding gate 32 is resiliently urged against the stationary plate 22 into sealing engagement therewith by a plurality of coil spring devices 42 spaced around the tube 34. Each spring device 42 acts between the carrier 28 and the sliding gate 32. For further details of the arrangement of the spring devices 42, reference may be made to the said application Ser. No. 377,385.

The piston and cylinder assembly 29 comprises a hydraulic cylinder 316 to which hydraulic fluid is supplied via hydraulic lines 362. A piston 363 is mounted in the cylinder 316 and is secured on a hollow ramrod 365. The ramrod 365 extends through a ramshield 364 to be secured to the gate carrier 28, the ramshield 364 being secured in the bracket 30.

The stationary plate 22 fits within a recess in the mounting plate 20 and also the stationary plate 22 contains a central annular groove proportioned to receive an annular ring 308 of the outer nozzle member 19.

The plate 22 comprises two straight parallel sides joined by semi-circular end portions as described and shown in Application Ser. No. 387,570, filed Aug. 10, 1973 (now U.S. Pat. No. 3,926,406) and comprises a refractory body 309 encased in a thin-walled steel casing 310 (e.g. between 2.5 and 3.0 m.m. in thickness). The refractory body 309 is secured in the casing 310 by means of a heat settable cement.

The sliding gate 32 similarly comprises a refractory body provided by the tube 34 and ring members 36, 38; this refractory body comprises (FIG. 2) an upper portion having straight parallel sides and semicircular end portions corresponding to the stationary plate 22 and a lower circular cylindrical portion. Again, the refractory body is encased in a thin-walled steel casing 370 (again for example between 2.5 and 3.0 m.m. in thickness), while leaving exposed an upper surface of the member 36 and a lower surface of the member 38 and nozzle tube 34. Again, the refractory body is secured in the casing 370 by a heat settable cement.

The nozzle tube 34 of the sliding gate 32 consists of a highly erosion resistant permeable refractory material which provides a permeable side wall 437. The wall thickness of the nozzle tube 34 is e.g. between 10 and 25 m.m. The lower ring member 38 surrounding the nozzle tube 34 is of low conductivity permeable refractory material. The upper ring member 36 which is in sliding contact with the stationary plate 22 is of an abrasion resistant refractory material comparable to that of which the stationary plate 22 is formed.

The permeable refractory material of the nozzle tube 34 is for example zirconia or zircon. The refractory material of the lower ring member 38 is for example fireclay, or a low alumina having e.g. an alumina content of about 40%; this refractory material may be impregnated with a carbonaceous impregnant e.g. tar, pitch or colloidal graphite. The abrasion resistant material of the upper ring member 36 is for example a high alumina having e.g. an alumina content in the range of 85%–95% by weight.

The slidably engaging surfaces of the member 36 and the stationary orifice plate 22 are ground and polished to provide required sealing characteristics.

Figure 2:
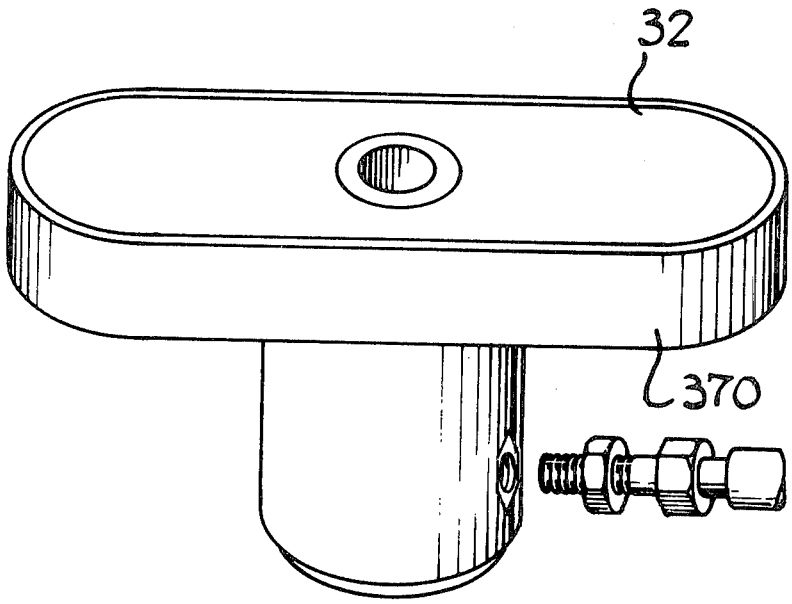
FIG. 2 shows a perspective view of a sliding gate member of the assembly.

It will be noted from FIG. 2 that the sliding gate 32 is symmetrical in plan view about each of the two axes at right angles; this enables reversal of the sliding gate 32 to even the effects of erosion.

The sliding gate member 32 also comprises a metal gas inlet fitting 440 secured within a lower portion of the ring member 38; the material of the ring member 38 extending between the fitting 440 and the tube 34. The inlet fitting 440 is internally screw threaded to receive a complementary externally threaded gas inlet nipple 442 which is connected to a supply of inert gas via a flexible hose 444. The sliding gate member 32 is sealed against escape of gas at the lower surface of the ring member 38 and the nozzle tube 34 by sealing means 446. The inlet fitting 440, nipple 442 and flexible hose 444 are located above a heat shield (not shown) of the sliding gate assembly to protect them from extreme heat.

In operation while aluminium killed steel flows through the nozzle tube 34 insert gas, e.g. argon, is supplied into the nozzle tube 34 through the permeable side wall 437 via the hose 444, the nipple 442 and the inlet fitting 440 and by diffusion through the ring member 38 and the refractory material of the nozzle tube 34 as indicated by arrows in the drawing. The flow rate and pressure of the gas are such that the flow of steel through the tube 34 is not substantially throttled.

Examples of gas flow rates and pressures through the hose 444 are between 5 cubic feet per minute (ambient temperature) and 60 cubic feet per minute (ambient temperature) at pressures ranging from 20 p.s.i.g. to 50 p.s.i.g., e.g. 10 cubic feet per minute (ambient temperature) at 20 p.s.i.g.

The inert gas apparently forms a separating film between the steel being poured through the nozzle tube 34, and the side wall 437 which facilitates smooth pouring and minimises the risk of blockage through the action of deoxidation products. It is desirable to have the inert gas available as high as the region of the stationary orifice plate.

While not wishing to be bound by theory, we believe that supply of inert gas through the nozzle tube 34 acts in two ways to minimise alumina build-up in the pouring of aluminum killed steels:

a. the inert gas acts as a purge generally to prevent ingress of air which would cause oxidation of aluminum in the steel to alumina with subsequent deposition of the alumina on the refractories;

b. the inert gas provides a nearly stationary boundary layer on the internal surfaces of the tube 34 which shields the surfaces from the steel which it is believed would otherwise itself provide a nearly stationary boundary layer from which alumina deposition would readily take place.

In any appropriate case of metal blockage oxygen is supplied through the permeable side wall of the nozzle tube 34 to re-melt the metal and relieve the blockage.

It will be understood that if the refractory material of the ring member 38 is impregnated with a carbonaceous impregnant this reduces its permeability and the gas supply arrangements are then modified so that they do not depend on diffusion through the ring member 38, e.g. by providing suitable gas passage means communicating with the nozzle tube 34 through the ring member 38.

Figure 4:
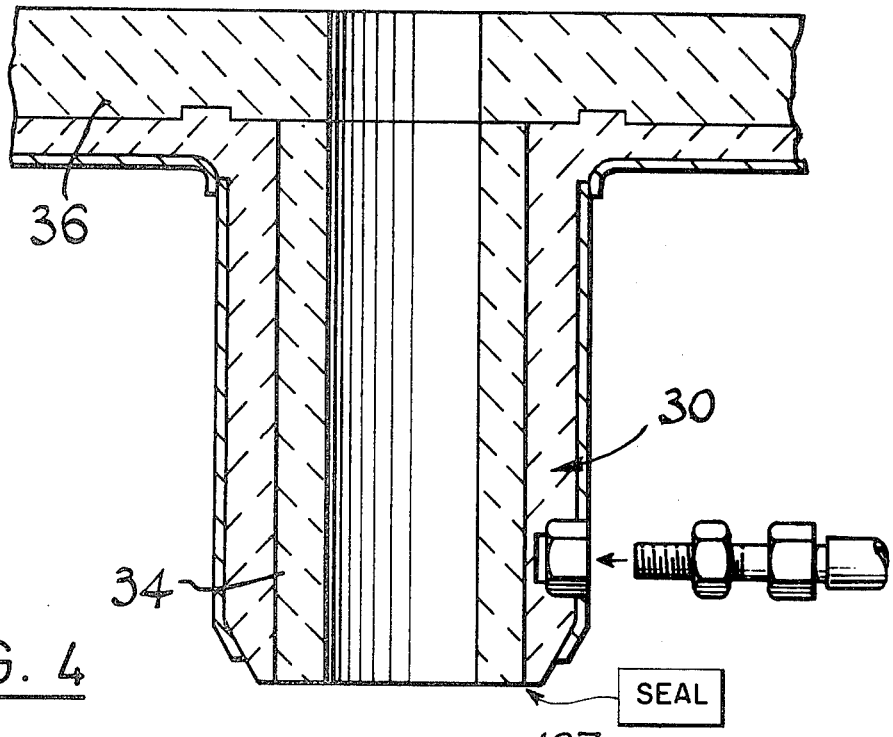
FIG. 4 shows a modified sliding gate member.
Figure 3:
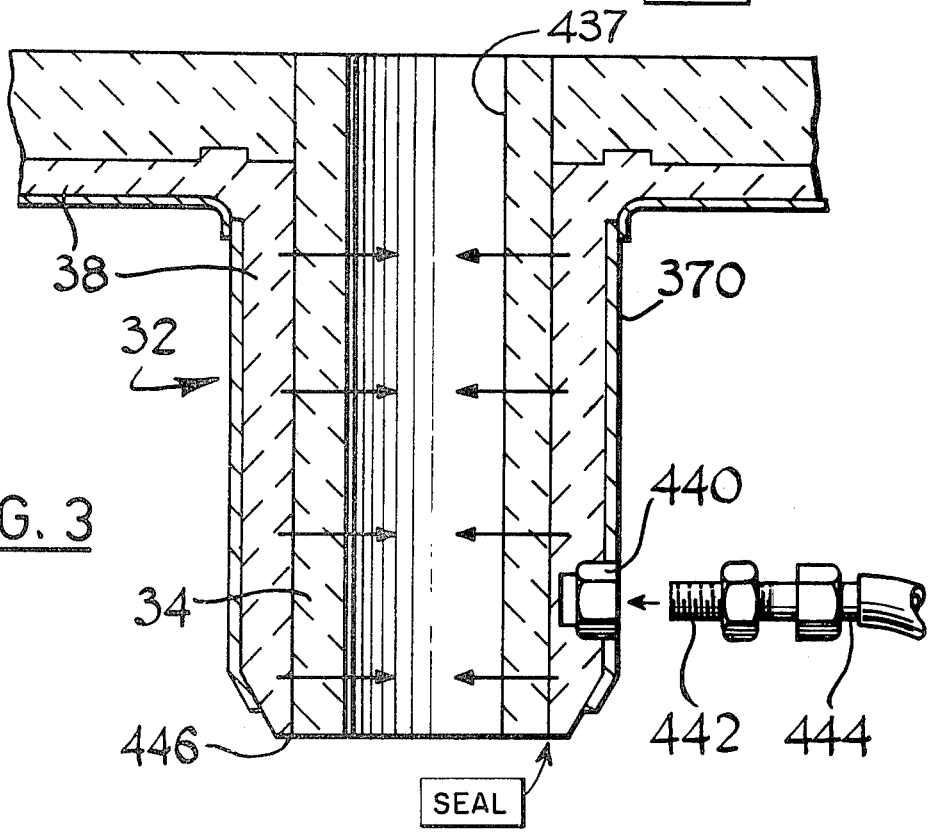
FIG. 3 shows an enlarged sectional side view of the sliding gate member.

In a modification (FIG. 4) of the sliding gate the refractory ring member 36 of the sliding gate 32 is of identical shape and dimensions to a corresponding refractory part of the stationary orifice plate, and in this case it will be seen that an upper end portion of the nozzle tube 34 terminates at a lower surface of the ring member 36 rather than extending through the ring member 36.

In another modification (not shown) instead of the whole of the material of the ring member 38 being of specially permeable refractory material, it may be provided with a porous insert with which the inlet fitting 40 communicates.

Shapland et al. Patent No. 3,841,539 discloses a replaceable nozzle tip and in another modification embodying the present invention, the side wall portion of permeable refractory material and the gas inlet are provided in a nozzle tip which is otherwise according to said U.S. Pat. No. 3,841,539, the entire disclosure of which is incorporated herein by reference.

Again Application Ser. No. 539,665, filed Jan. 9, 1975 discloses sliding gate valve assemblies which may readily be modified to embodying the present invention, and the entire disclosure of said last-named application is incorporated herein by reference.

It will be realised that the sliding gates which have been described hereinbefore may be readily adapted for use in sliding gate valve assemblies for controlling flow of metal from tundishes or other metal holding vessels or furnaces, as well as from ladles in the continuous casting of steel, and also although the above description has been given with reference to a bottom pour vessel it will be realised that sliding gate assemblies embodying the invention may also be incorporated in for example side pour vessels.

I claim:

1. In a slidable gate member for controlling flow of liquid metal through an outlet in the bottom wall of a vessel, said member comprising:

metal encased superposed upper and lower refractory rings having an orifice;

the refractory of said upper ring being abrasion resistant for sliding contact with a plate thereabove;

the refractory of said lower ring being of low conductivity;

a nozzle depending from said plate and having a passage extending from said orifice;

the improvement in which said nozzle comprises:

an annular member of low-conductivity permeable refractory material extending from said lower ring;

a metal casing enclosing the outer circumference of said annular member;

a sleeve of highly erosion resistant permeable refractory inside said annular member and having a bore which defines said passage;

an inlet connected with said annular member and extending through said casing for introducing gas to said sleeve and through the permeable refractory thereof to said bore throughout the length of said sleeve to form a separating film between the metal being poured and the inside surface of said sleeve; and means forming a seal at the lower surface of said annular member to prevent escape of gas.

2. A sliding gate member as defined in claim 1 in which said annular member is formed of fire clay.

3. A sliding gate member as defined in claim 1 in which said sleeve is formed of zirconia.

* * * * *